US009078518B2

(12) United States Patent
Braun

(10) Patent No.: US 9,078,518 B2
(45) Date of Patent: Jul. 14, 2015

(54) BOTTOM MOUNT ADJUSTABLE CABINET MOUNTED FRAME

(71) Applicant: Thomas Braun, Glen Head, NY (US)

(72) Inventor: Thomas Braun, Glen Head, NY (US)

( * ) Notice: Subject to any disclaimer, the term of this patent is extended or adjusted under 35 U.S.C. 154(b) by 0 days.

(21) Appl. No.: 14/015,773

(22) Filed: Aug. 30, 2013

(65) Prior Publication Data

US 2014/0062280 A1 Mar. 6, 2014

Related U.S. Application Data

(60) Provisional application No. 61/694,884, filed on Aug. 30, 2012.

(51) Int. Cl.
*A47B 88/04* (2006.01)
*A47B 96/00* (2006.01)

(52) U.S. Cl.
CPC ..... *A47B 88/0466* (2013.01); *A47B 88/044* (2013.01); *A47B 96/00* (2013.01); *A47B 2210/0054* (2013.01)

(58) Field of Classification Search
CPC ..... A47B 88/0044; A47B 88/0055; A47B 88/18; A47B 2210/0054
USPC ..... 312/334.27, 330.1, 331, 332, 334.5, 312/334.4, 334.6, 334.32, 334.44, 273
See application file for complete search history.

(56) References Cited

U.S. PATENT DOCUMENTS

| | | | | |
|---|---|---|---|---|
| 3,528,718 | A * | 9/1970 | Braun et al. | 312/308 |
| 3,722,964 | A * | 3/1973 | Chitester et al. | 384/18 |
| 3,844,627 | A | 10/1974 | Gutner | |
| 4,984,762 | A * | 1/1991 | Braun et al. | 248/216.1 |
| 5,039,053 | A | 8/1991 | Malinowitz | |
| 5,161,797 | A | 11/1992 | Frasca | |
| 5,211,461 | A * | 5/1993 | Teufel et al. | 312/334.4 |
| 5,251,975 | A * | 10/1993 | Braun et al. | 312/334.16 |
| 5,662,371 | A | 9/1997 | Gera et al. | |
| 7,810,890 | B2 * | 10/2010 | Klein et al. | 312/334.33 |
| 8,016,374 | B2 * | 9/2011 | Kropf et al. | 312/333 |
| 8,388,076 | B2 | 3/2013 | Walburn | |
| 8,622,493 | B2 * | 1/2014 | Roeck | 312/348.4 |
| 2001/0019235 | A1 * | 9/2001 | Hammerle | 312/334.4 |
| 2007/0018545 | A1 * | 1/2007 | Calabria et al. | 312/311 |
| 2014/0015391 | A1 * | 1/2014 | Feuerstein | 312/334.4 |

* cited by examiner

*Primary Examiner* — Daniel Rohrhoff
(74) *Attorney, Agent, or Firm* — Studebaker & Brackett PC

(57) ABSTRACT

An extendable and retractable container assembly for recyclable materials which includes a pair of drawer slide structures that are interconnected by a rear cross-member bracket and a front cross-member bracket to retain them in spaced parallel relation with the rear ends of the slide structures being independently adjustably supported by two unique adjusting structures.

19 Claims, 12 Drawing Sheets

BOTTOM MOUNT ADJUSTABLE CABINET MOUNTED FRAME

This application is a non-provisional application of U.S. patent application Ser. No. 61/694,884, filed Aug. 30, 2012, and hereby incorporated in its entirety by reference.

FIELD OF THE INVENTION

The present invention relates to the field of cabinet mounted hardware.

BACKGROUND OF THE INVENTION

It is often difficult to properly align a cabinet face with respect to the cabinet body. Due to the positioning of interiorly located slide assemblies within a cabinet, alignment of the cabinet face may be skewed. It is therefore an object of the present invention to properly align a cabinet face with respect to a cabinet body by minimal adjustments.

SUMMARY OF THE INVENTION

The present invention generally relates to a container assembly for recyclable materials mounted within a cabinet for movement between an extended position in which the open tops of the bins or containers are exposed for receiving recyclable materials and a retracted position in which the bins are concealed. The container assembly is supported for movement between its extended and retracted positions by a pair of drawer slide assemblies with supporting cross-member brackets being connected to the slide assemblies.

The slide assemblies are mounted on a bottom of the cabinet under a center of the load to be applied to the slide assemblies. The slide assemblies interengage with brackets on which a door can be mounted for adjustment to accurately fit the opening in the front wall to form a closure for the cabinet in which the container assembly is mounted. The container assembly is constructed to enable easy removal of the bins or containers, easy mounting and assembly and quick and effective adjustment with all adjustments being securely locked when all components of the assembly are oriented in an optimum adjusted position.

An object of the present invention is to provide an extendable and retractable container assembly for recyclable materials which includes a pair of drawer slide structures that are interconnected by a rear cross-member bracket and a front cross-member bracket to retain them in spaced parallel relation with the rear ends of the slide structures being independently adjustably supported by two unique adjusting structures.

Another object of the invention is to provide a container assembly for recyclable material in which the movable components of the drawer slide assemblies support at least one bin or receptacle for receiving recyclable materials with the upper ends of the bin or container being exposed and accessible when moved to an extended position to provide access thereto in order to enable categorized recyclable materials to be placed in the bin.

By including two independent adjusting structures at the rear of the slide assemblies, the adjusting structures raise and lower the slide assemblies independently of each other. This all occurs at the rear end of the slide assemblies.

However, in the front of the cabinet, where a Z-shaped cross-member bracket supports and is secured to the slide assemblies, the slide assemblies are caused to move independently of each other and adjust the position of the cabinet door by the torsional twist or flexure of the Z-shaped front cross-member bracket. Alternately, a C-shaped front cross-member bracket may be used.

This aids in moving the cabinet face so that the cabinet face lies flush against the cabinet in a vertical plane. A three-dimensional adjustment of the cabinet face is provided so as to secure an aesthetically pleasing proper alignment of the cabinet face.

Depending upon the independent adjustment of the two ends at the rear of the slide assemblies, the slide assemblies are caused to change relative positioning and thereby vary the alignment of the cabinet face. It is understood as being within the scope of the present invention that rotation of the independent adjustment assemblies in opposite directions, or in the same direction to different degrees, will cause the adjustment of the cabinet face to tip the alignment of the cabinet face.

The adjusting assembly is formed by machining of a full-hex threaded insert available as Atlas MaxTite® Blind Threaded Rivets distributed by PennEngineering of Dunboro, Pa. The threaded insert is machined to create a thinner walled round section located between the base and upper end of the insert. The round section begins at a height above the base at a height greater than a thickness of an L-shaped bracket. The threaded insert is placed in a hole of the L-shaped bracket. The insert is then compressed to form a lip. The threaded insert is captured within the hole of the L-shaped bracket between the base and the thus formed lip.

The threaded insert is of a dimension slightly less than the hole of the L-shaped bracket so as to allow free rotation of the threaded insert upon clockwise or counter-clockwise rotation of the threaded insert in an adjustment of the slide assemblies. The L-shaped bracket is securely connected by rivets to the rear of each of the slide assemblies. A bolt or stud is held securely by the rear cross member bracket and threaded through the threaded insert, thereby moving the L-shaped bracket upon rotation of the threaded insert and becoming an extension of the slide assemblies.

A plastic thumbscrew is rotatably mounted on a free end of the threaded bolt. The plastic thumbscrew acts as a lock to prevent loosening of the threaded insert on the bolt. The thumbscrew also acts a stop for the slide assemblies.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
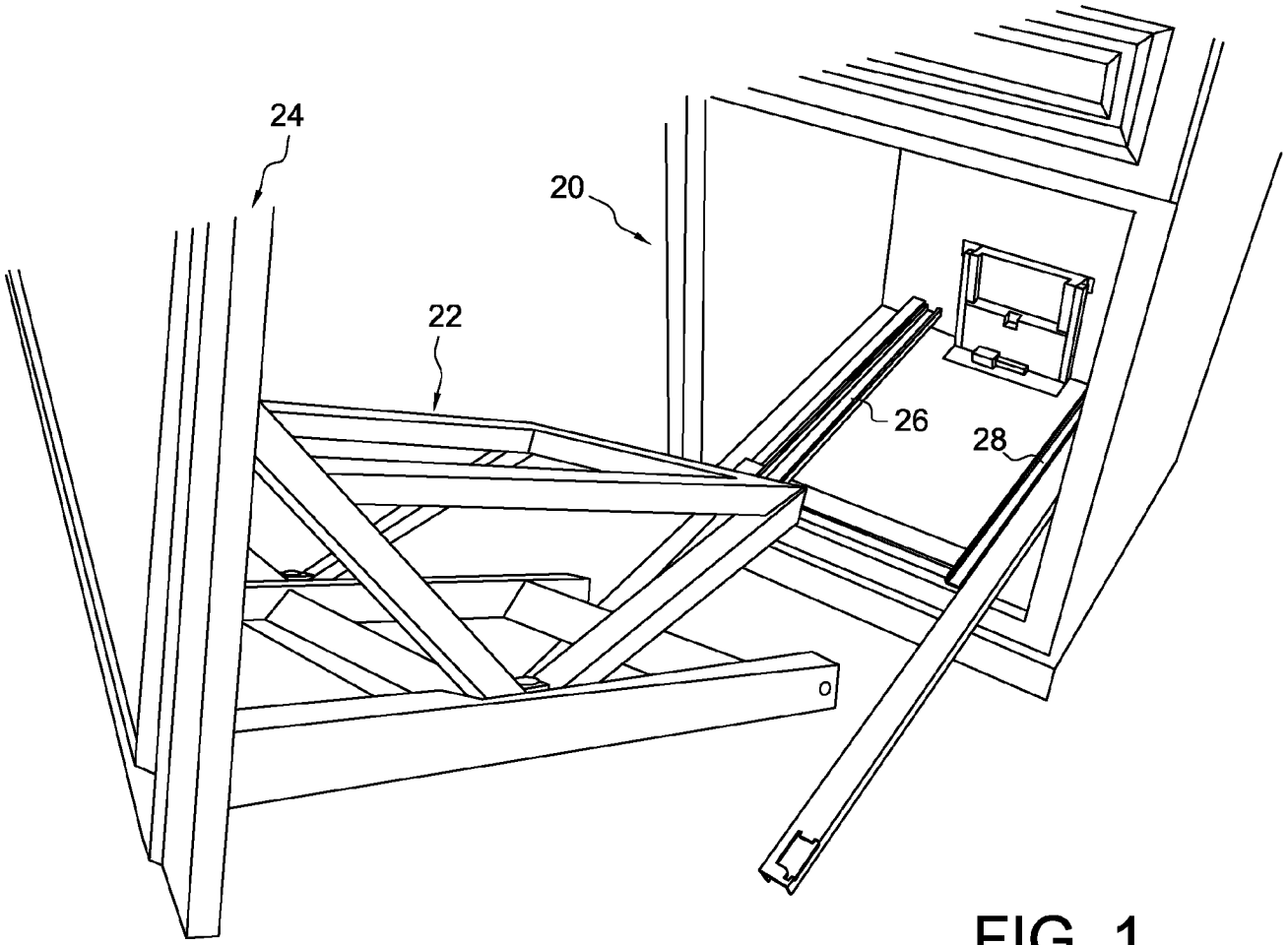
FIG. 1 is an exploded view of a cabinet mounted frame having a pair of slide assemblies and a front door panel mounted on a bin holder for interengaging with the slide assemblies.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2A:
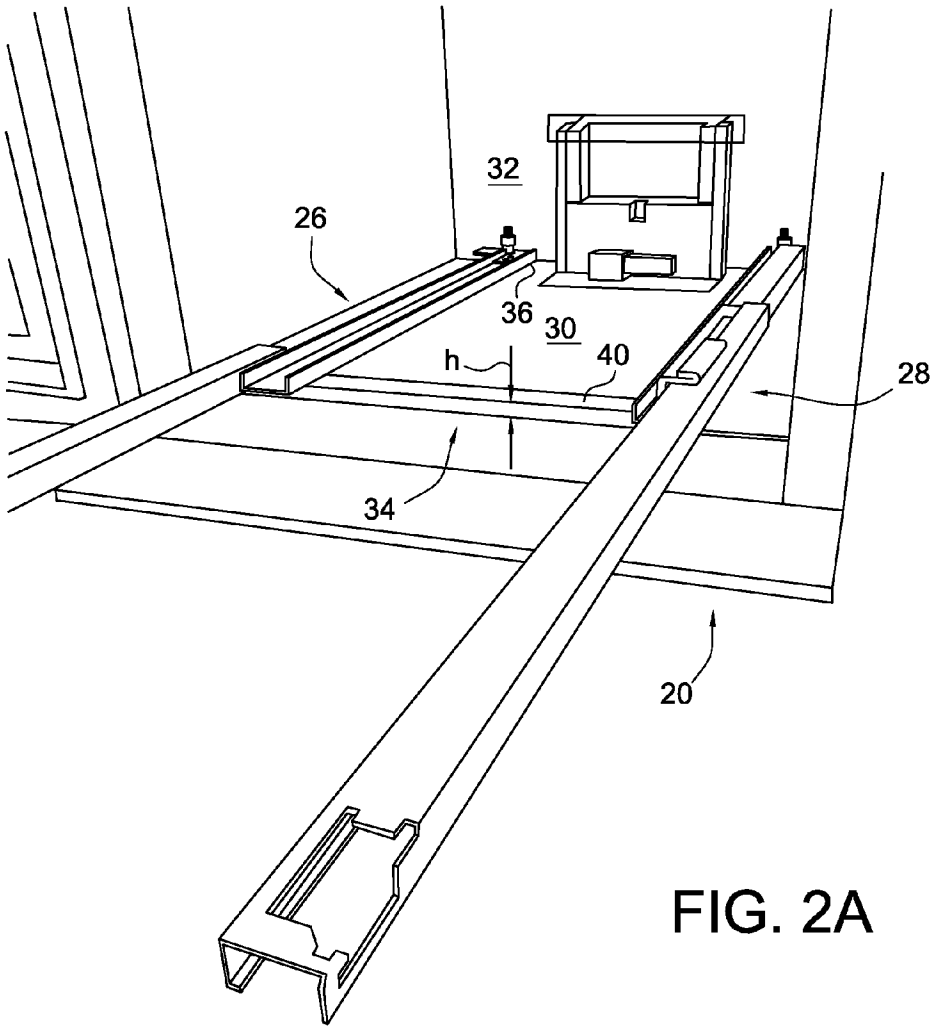
FIG. 2A is a perspective view of the interior of a cabinet having the adjustable cabinet mounted frame of the present invention with the slide assemblies in an extended position.
Figure 2B:
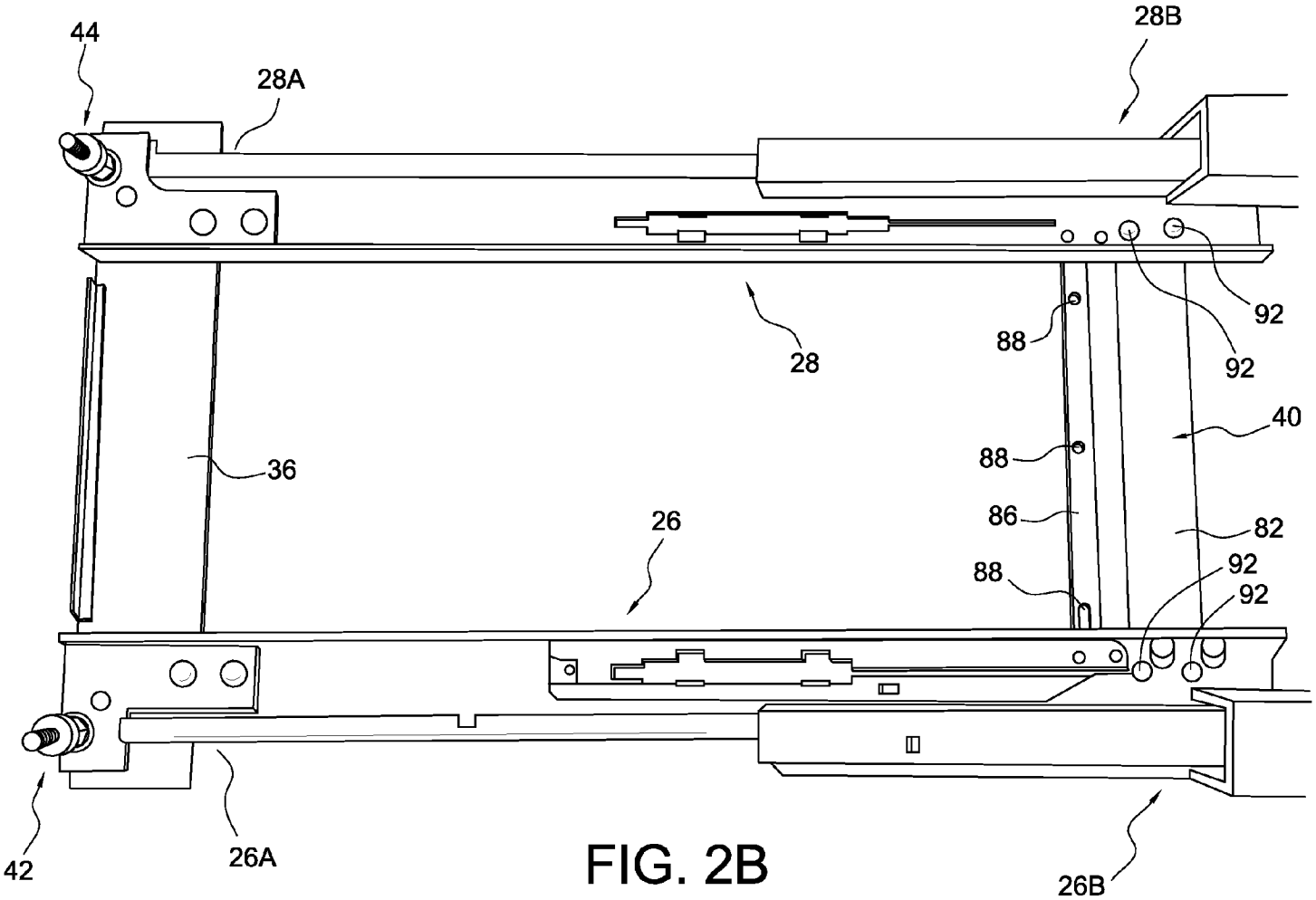
FIG. 2B is a top plan view of the two slide assemblies mounted into the bottom of a cabinet.
Figure 2C:
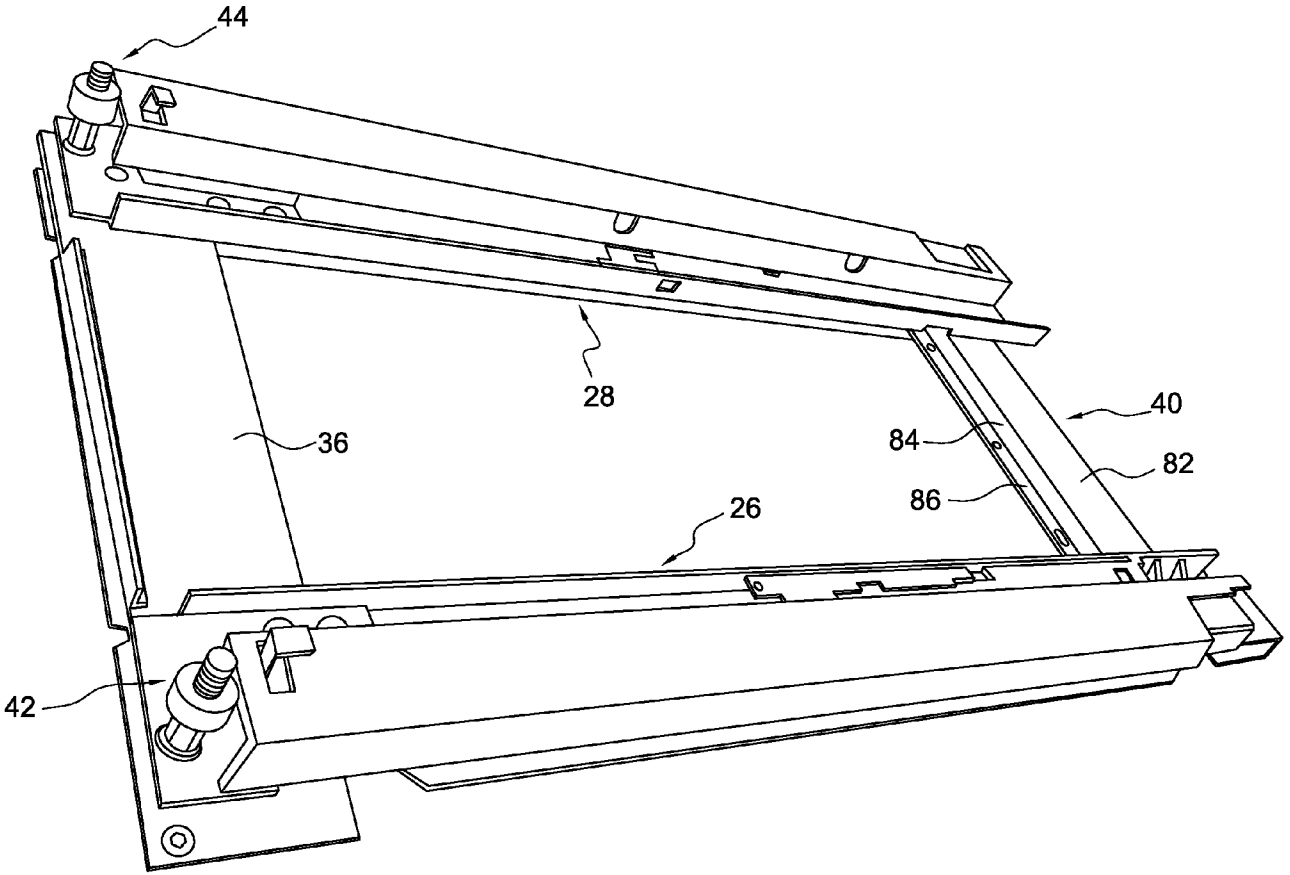
FIG. 2C is a perspective view of the two slide assemblies shown in a closed position.
Figure 3:
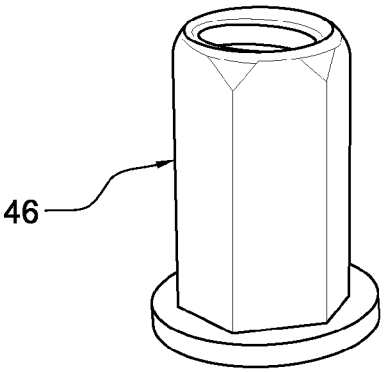
FIG. 3 is an exemplary view of a threaded insert prior to its modification.
Figure 4:
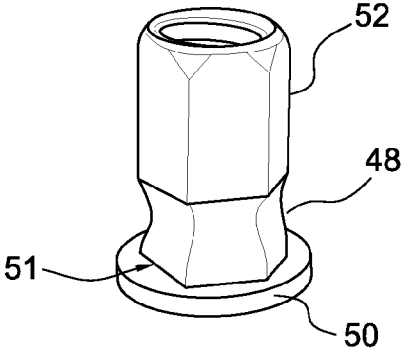
FIG. 4 is a modified version of the threaded insert shown in FIG. 3 with a portion of the external sidewalls removed in a round section at a spacing above the base and a portion of the threaded insert.

With respect to the drawings, and with reference to FIGS. 1 through 2C, in particular, the present invention is shown mounted inside on the bottom of a cabinet 20. In FIG. 1, a recycling bin fixture 22 secured to a front door panel 24 of the cabinet is shown at an angle for mounting on the two slide assemblies 26, 28. As shown in greater detail in FIG. 2A, the slide assemblies 26, 28 are mounted on the bottom 30 of the cabinet 20. The slide assemblies extend from the rear 32 of the cabinet towards its front edge 34.

As shown in the plan view of FIG. 2B, the slide assemblies 26, 28 are interconnected at a rear end 26A, 28A by a rear cross member 36. Similarly, at the front end of the cabinet, the two slide assemblies 26, 28 are interconnected at front ends 26B, 28B by a front cross-member 40.

In FIG. 2B, the two slide assemblies are shown in the extended position. In FIG. 2C, the two slide assemblies are showed in the retracted position.

Figure 6:
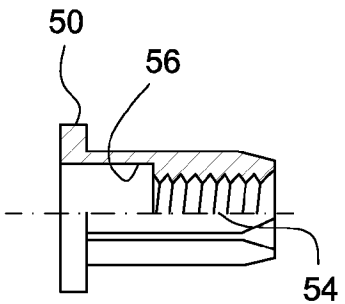
FIG. 6 is a cross-sectional view of the threaded insert shown in FIG. 3.
Figure 7:
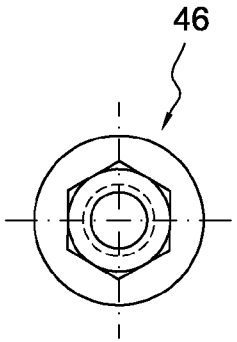
FIG. 7 is a top plan view of the threaded insert shown in FIG. 3.

In forming the two adjustment mechanisms 42, 44, as shown at the rear ends 26A, 28A of the two slide assemblies, a threaded insert 46 is initially machined to reduce the treaded insert in cross-section and form a round relief collar portion 48. The removal of material is above the base 50 and above a portion 51 of the hex shaped threaded insert, but below the remaining internally threaded portion 52. The removal of material at the relief collar 48 provides for a weakening of the structure of the threaded insert 46 above portion 51. This reduced diameter portion forms a round outer circumference for subsequent crushing to form a rim 58. As shown in FIGS. 6 and 7, the threaded insert 46 includes an internally threaded portion 54 having an external hexagonal shape. Also, a round hollow interior portion 56 is located on the interior of the threaded insert.

Figure 5:
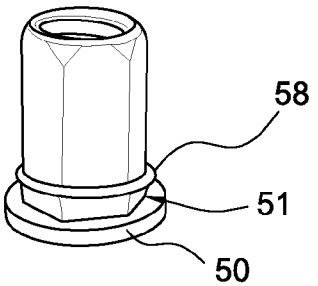
FIG. 5 illustrates the threaded insert in a compressed configuration to form a rim for encasing an L-shaped bracket between the rim and a flat head of a bolt.

Due to the weakening of the threaded insert at the relief collar by the removal of material and thus a thinning of the wall thickness, when the threaded insert is subjected to a compressive load in a press, the threaded insert will collapse along the portion 48 and produce an externally directed lip or rim 58. In FIG. 5, the threaded insert is shown in a fully collapsed position as a result of compressive force. This example shows the portion 51 which remains. Portion 51 has a height of approximately 0.080 inches. This height should be maintained at approximately 0.010 inches greater than a thickness of an L-shaped bracket within which the insert is to be located.

Figure 8:
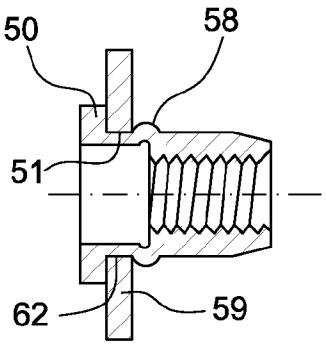
FIG. 8 is a cross-sectional view of the threaded insert after a rounded portion forming a relief collar has been removed and the threaded insert is compressed to be captured within a hole of an L-shaped bracket while allowing free rotation of the threaded insert.

As more aptly shown in FIG. 8, the crushing of portion 48 of the threaded insert produces the rim 58 but only to a point such that a bracket 59, for example, is captured surrounding portion 51 between base 50 and rim 58. Bracket 59 has a thickness of approximately 0.072 inches +/−0.005 inches. The threaded insert 46 is of a lesser diameter than the hole 62 formed in the bracket 59 such that when the insert 46 is placed in hole 62 and after compression of the threaded insert, the portion 51 of the threaded insert is still capable of freely rotating within the hole 62 of the bracket 59. This function will be explained further with reference to FIGS. 12 through 14.

Figure 10:
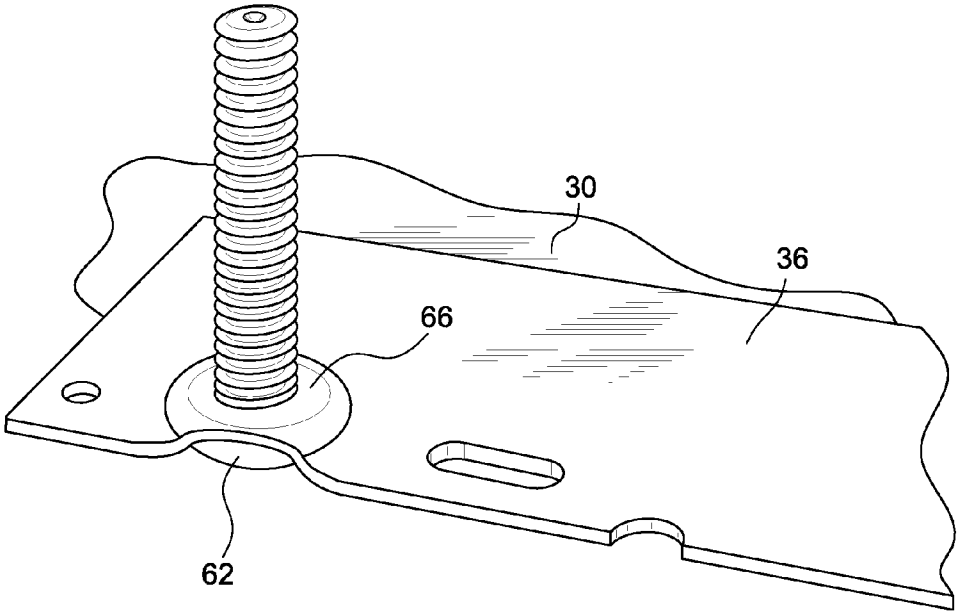
FIG. 10 illustrates the capturing of the head of the bolt shown in FIG. 9 within a recess of a rear cross member bracket so as to fix the bolt in place.
Figure 9:
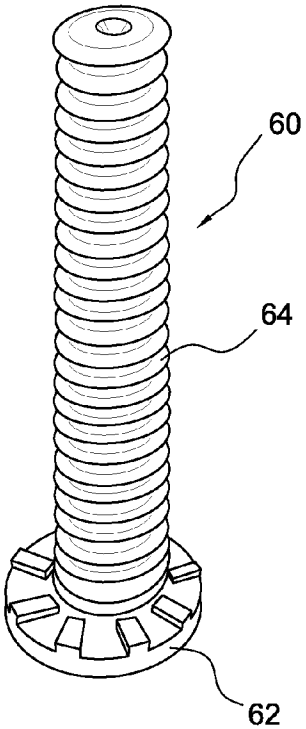
FIG. 9 illustrates a flat head stud bolt for use with the slide assemblies of the present invention.

In FIG. 9, a stud bolt 60 is shown having flattened head base 62 and threaded portion 64. This bolt has a height of approximately 3 to 4 inches. The head 62 is captured and fixedly held in place in a recess formed in the rear cross-member 36 as shown in FIG. 10. In this position, when the rear cross-member is secured to the bottom 30 of a cabinet, the head 62 is held in place and prevented from rotating within the swaged portion 66 of the rear cross-member 36.

Figure 11:
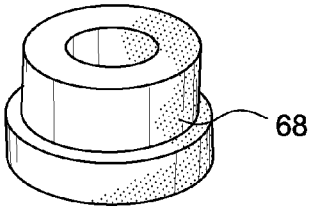
FIG. 11 illustrates a nylon knurled nut which acts as a stop for rearward movement of the slide assembly and for locking the position of the threaded insert on the bolt.

In FIG. 11, a nylon knurled nut 68 is shown. This nut 68 fits on top of the free end of the bolt 60 to secure the positioning of the threaded insert onto the bolt 60 and also serves as a stop for engagement with the slide assemblies 26, 28, as shown in FIG. 2C, when the slide assemblies are in their retracted position.

Figure 12:
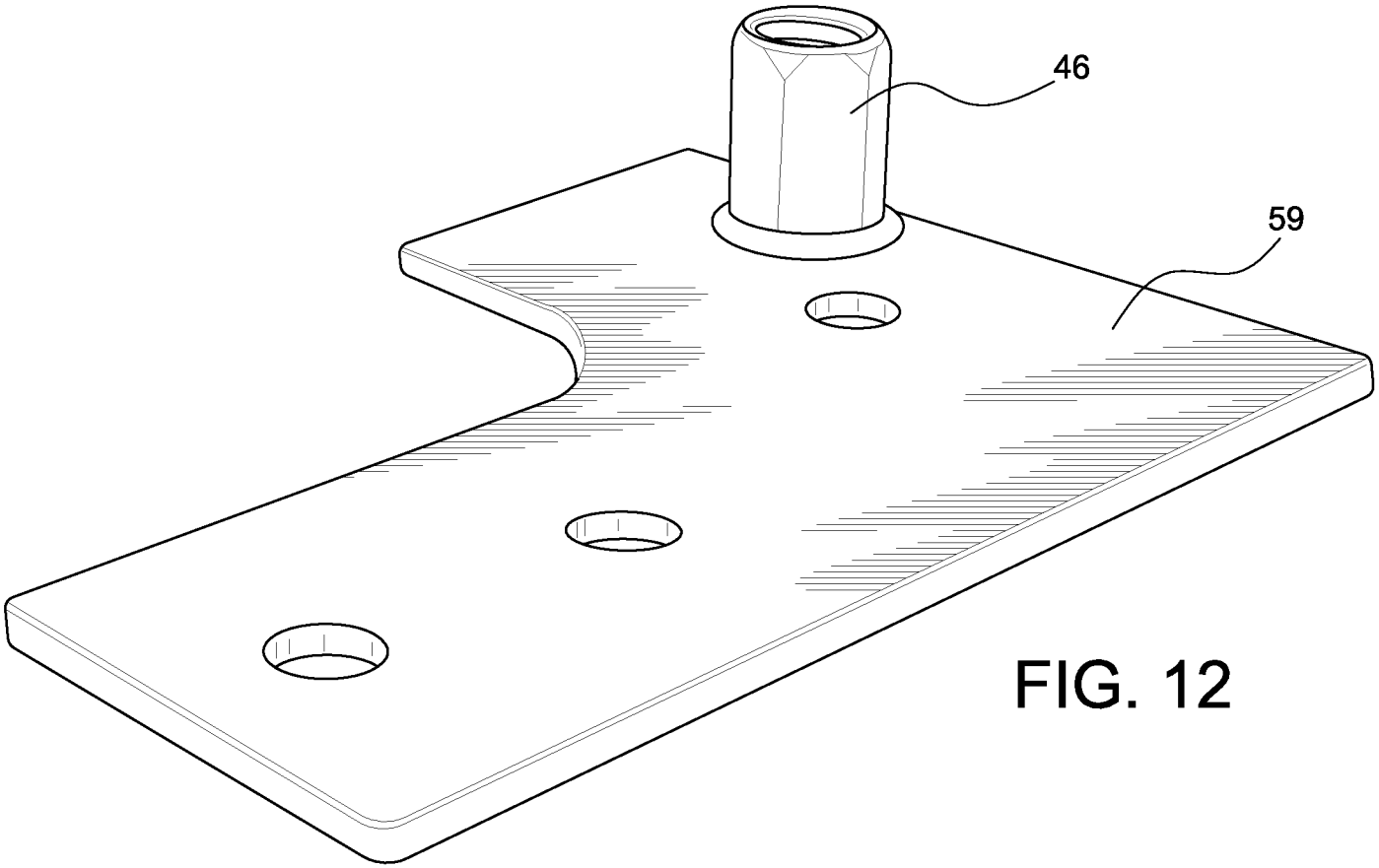
FIG. 12 illustrates an L-shaped bracket having the modified threaded insert of the present invention captured within a hole of the L-shaped bracket for free rotation of the threaded insert.

In FIG. 12, the specially modified threaded insert 46 is shown rotatably mounted within a hole of an L-shaped bracket 59. The threaded insert is allowed to freely rotate in the L-shaped bracket while being retained in its position relative to the L-shaped bracket 59.

Figure 13:
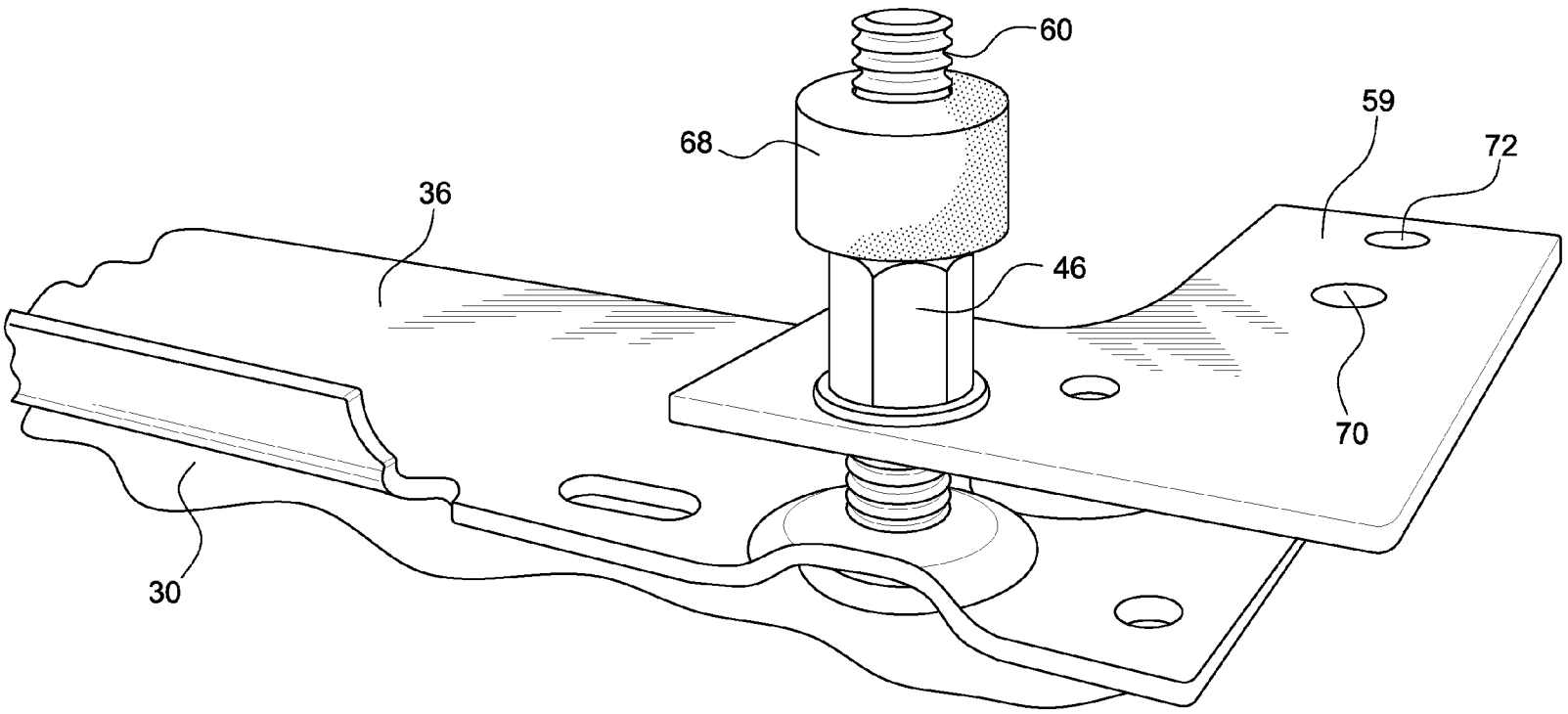
FIG. 13 illustrates the mounting of the L-shaped bracket onto a bolt held securely in place on the rear cross member bracket with the nylon knurled nut placed over the threaded insert to secure the location of the threaded insert.
Figure 14:
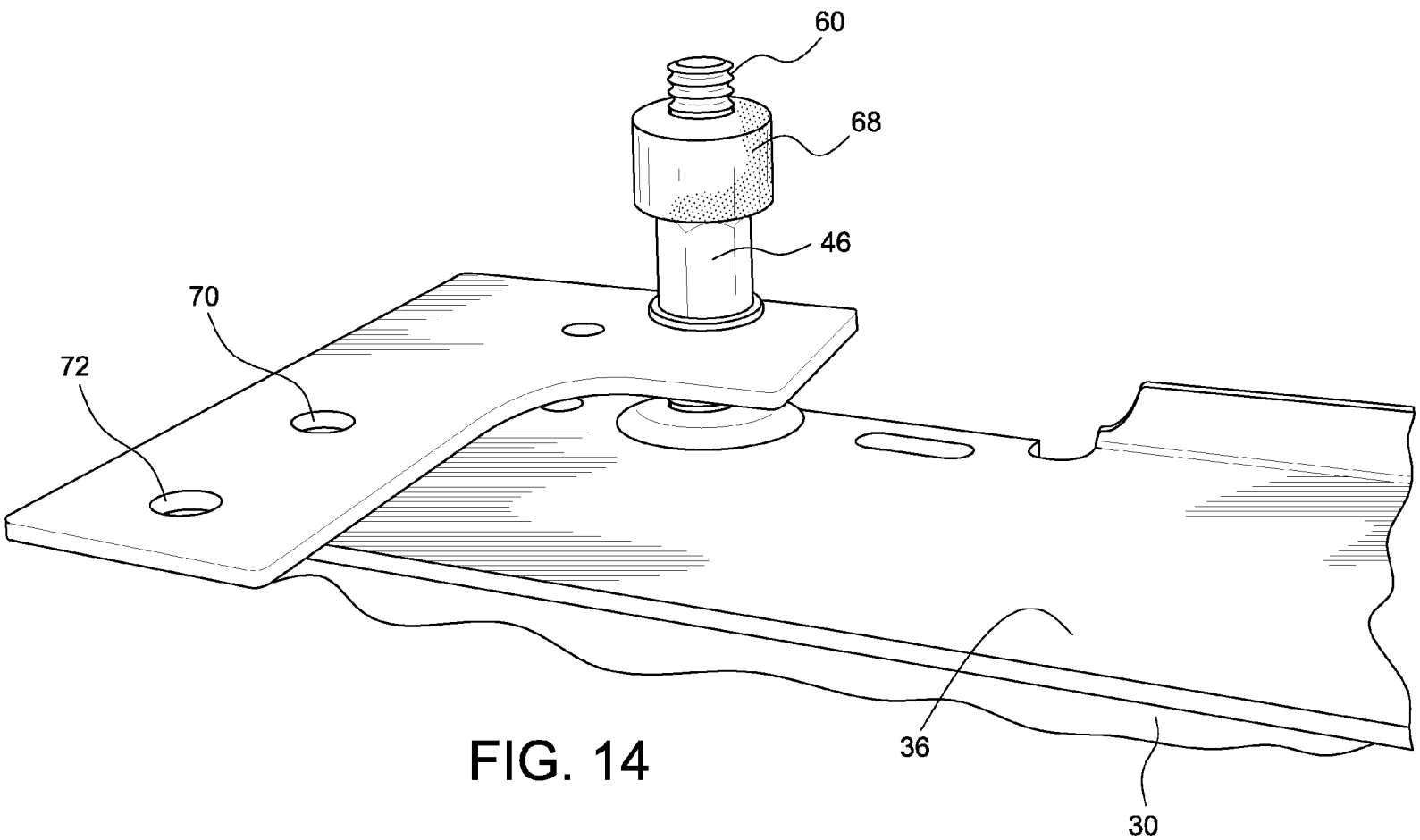
FIG. 14 is an opposite side view of the assembly shown in FIG. 13.

In FIGS. 13 and 14, the bolt 60 is shown secured to the rear cross-member 36. The rear cross-member is in turn secured to the floor 30 of the cabinet. The modified threaded insert 46 is threaded onto the bolt 60 and rotated until the threaded insert 46 with its associated L-shaped bracket 59 approaches, but is spaced from the rear cross-member 36. The nut 68 is shown in position securing the threaded insert 46 from being rotated, but it is understood that the nut 68 may be removed for further adjustment of the threaded insert 46 by clockwise or counter-clockwise rotation of the threaded insert to move towards the cross-member 36 or away from the cross-member 36.

Figure 15:
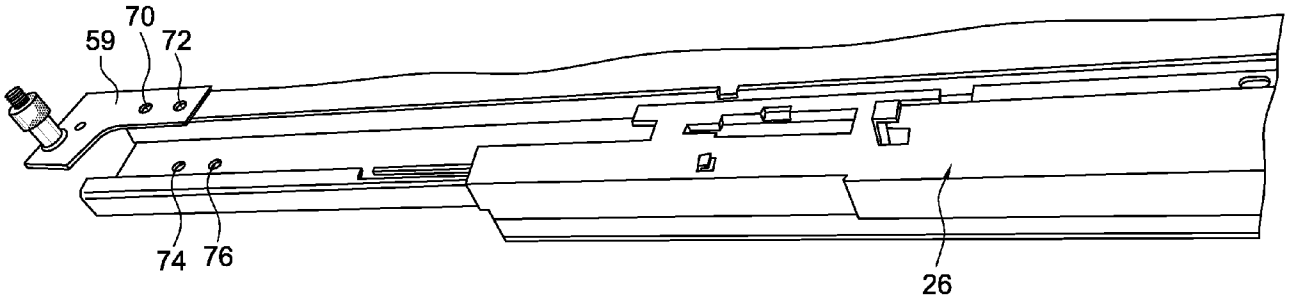
FIG. 15 is an exploded view of the L-shaped bracket and slide assembly prior to mounting of the L-shaped bracket by rivets onto the slide assembly.

As shown in FIG. 15, the L-shaped bracket 59 has two rivet holes 70, 72. The bracket 59 is moved to engage with the slide assembly 26 having rivet receiving holes 74, 76. Rivets 78, 80 secure the bracket 59 to a slide assembly through aligned rivet holes 70, 72 and 74, 76, respectively.

Figure 16:
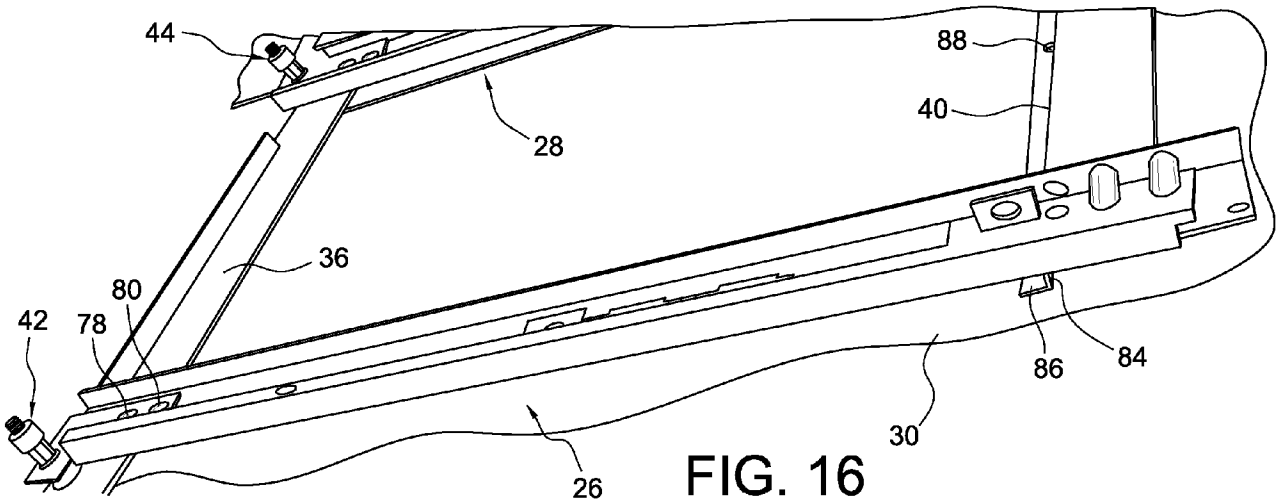
FIG. 16 illustrates the two adjustment mechanisms of the present invention mounted onto the rear end of two slide assemblies with the two slide assemblies interconnected by a rear cross-member bracket and a front cross-member bracket.

As shown in the assembled form in FIG. 16, rivets 78, 80 extend through the rivet receiving holes 70, 72 of the L-shaped bracket 59 and the rivet receiving holes 74, 76 of the slide assembly 26 to secure the adjustment assembly 42 on the rear cross-member 36 and the slide assembly 26. Similarly, the opposed adjustment mechanism 44 is secured to the slide assembly 28. By this positioning, the threaded inserts 46 on each of the two L-shaped brackets 59 may be rotated to independently move the rear ends of the two slide assemblies 26, 28 up and down with respect to the rear cross-member 36.

Figure 17:
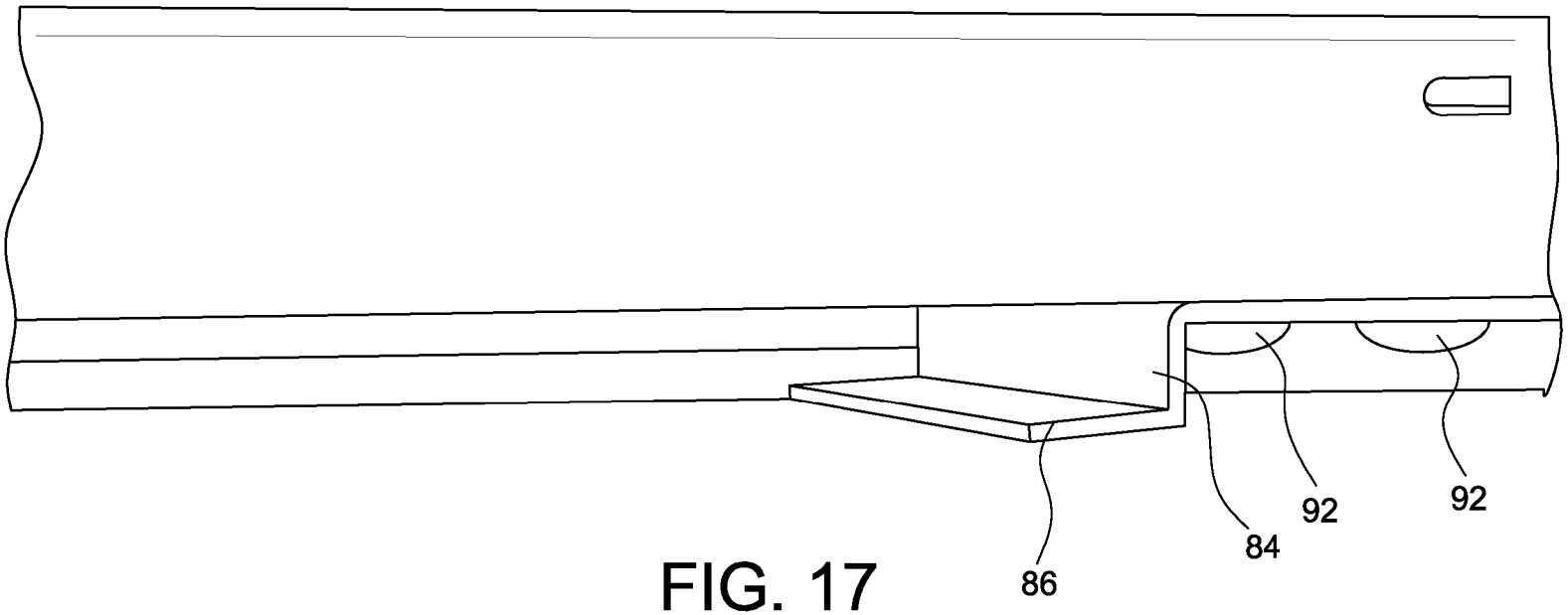
FIG. 17 illustrates the Z-shaped front cross-member bracket secured by rivets underneath and to the two spaced apart slide assemblies.
Figure 18:
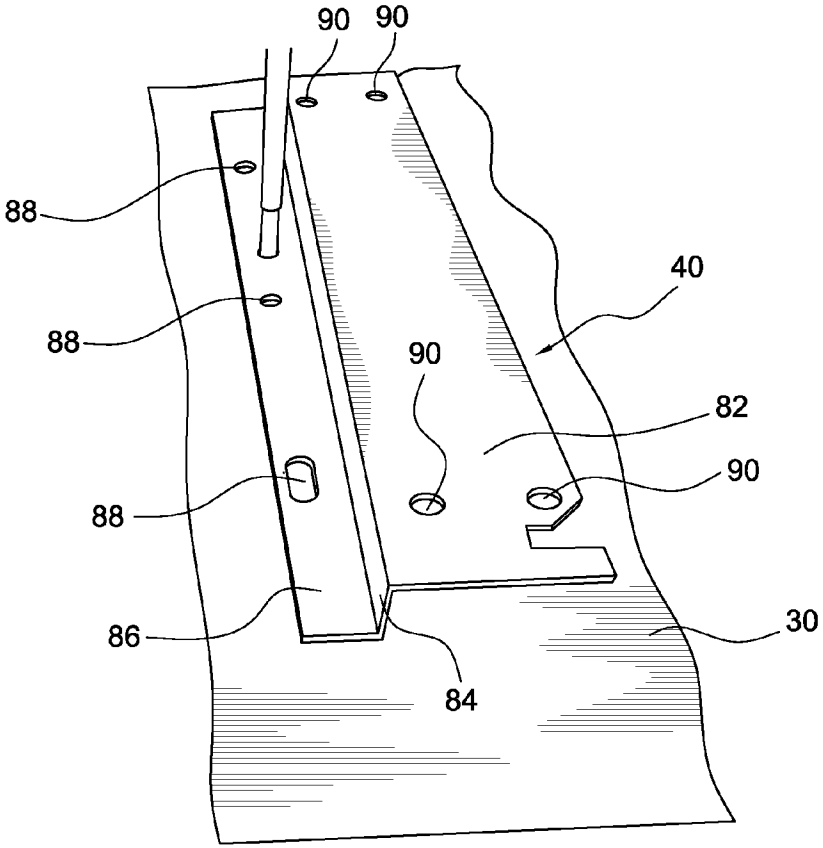
FIG. 18 illustrates the Z-shaped front cross-member bracket prior to its installation on the bottom of the cabinet and secured by rivets to two slide assemblies.

At the opposite ends of the slide assemblies 26, 28, the slide assemblies are also riveted to the front cross-member 40. The front cross-member 40 as shown in FIGS. 17 and 18 is of a Z-shaped configuration having a thickness from 18 to 14 gauges. As shown in FIG. 18, the front cross-member 40 includes a horizontally extending portion 82 which is vertically spaced above the cabinet floor 30 by a vertically extending or rising portion 84. Portion 82 has a width of approximately 1.5 inches.

Portion 84 terminates at the cabinet floor 30 by another horizontally extending portion 86. Portion 86 has a width of approximately 0.5 inches. Portion 86 is secured to the cabinet floor 30 by screws or bolts passing through holes 88 to elevate portion 82 above the floor 30 by a height "h" of approximately 0.5 inches, and preferably 0.42 inches.

As shown in portion 82, rivet holes 90 are formed for connection with the front ends of the slide assemblies 26, 28. The bottom of rivets 92 are shown in FIG. 17. As shown in FIG. 16, and in more detail in FIG. 17, the vertically extending or vertically rising portion 84 spaces the horizontally extending portion 82, and thereby the front ends of the slide assemblies 26 and 28, above the cabinet floor.

In the operation of the present invention, the front cabinet door 24 is mounted onto an assembly 22 which slides on slide assemblies 26 and 28. To achieve a perfect alignment of the cabinet door 24 with respect to the cabinet 20, it is necessary to adjust the relative three dimensional alignment between the rear face of the cabinet door and the front face of the cabinet. This is oftentimes difficult to achieve.

By the present invention, independent rotation of the threaded insert of the two adjustment mechanisms 42, 44 achieves an independent relative transposition of the cabinet door by the balanced deflection of the front cross-member rigidly secured to the slide assemblies. The horizontally extending portion 82 of the front cross-member is caused to "twist" by the relative independent rotation of the threaded inserts on the bolts 60 at the rear of the slide assemblies. Due to the disparity in height between the rear ends of the slide assemblies, a diagonal twisting of portion 82 translates into an adjustment of the relative positioning of the cabinet door.

For example, if one adjustment assembly has its threaded insert rotated towards the head 62 of the bolt 60 whereas the other threaded insert, on the opposed adjustment mechanism, is unscrewed away from the head 62, the two slide assemblies will be caused to move in opposite directions with the net balancing between the two assemblies causing a shifting of the cabinet door along a plurality of axes to provide for proper alignment of the cabinet door with respect to the cabinet frame by a torsional twisting of the front cross member.

It is understood that the rotation of the threaded inserts may be of differing amounts in the same direction either towards the bolt head 62, or in opposite directions, or away from the bolt head 62, as well as rotation of only one of the threaded inserts to cause the required shifting of the cabinet door.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. An adjustable cabinet mounted frame for controlling an orientation of a cabinet door of a cabinet within which the frame is mounted, said adjustable cabinet mounted frame comprising two spaced apart slide assemblies, a front cross-member secured to and interconnecting a front end of each of the two slide assemblies, the front cross-member being configured for being secured to the cabinet, and two adjustment mechanisms connected to a rear end respectively of each of the two slide assemblies, said two adjustment mechanisms being independently operable to raise and lower the respective rear end of each of the two slide assemblies, said front cross member being flexible and twistable to accommodate independent operation of said adjustment mechanisms to control an orientation of the slide assemblies and thereby the orientation of the cabinet door with respect to the cabinet dependent upon an amount of independent adjustment of the adjustment mechanisms, the front cross member including a horizontally oriented portion connected to said two slide assemblies and a vertically rising portion elevating the horizontally oriented portion above a floor of the cabinet.

2. The adjustable cabinet mounted frame of claim 1, wherein the front cross-member includes another horizontally oriented portion for securing the front cross-member to the floor of the cabinet.

3. The adjustable cabinet mounted frame of claim 1, wherein each of the adjustment mechanisms includes a bolt fixed with respect to a floor of the cabinet and a threaded insert rotatably mounted on the bolt to independently raise or lower the rear end of the respective slide assemblies upon rotation of the threaded insert.

4. The adjustable cabinet mounted frame of claim 3, wherein the threaded insert of each adjustment mechanism is rotatably mounted in a bracket, the bracket is secured to the rear end of each of the respective slide assemblies to raise or lower the rear end of the slide assemblies upon rotation of the threaded insert for pivoting of the slide assemblies about the front cross-member and thereby adjusting the orientation of the cabinet door dependent upon the independent adjustment of the adjustment mechanisms.

5. The adjustable cabinet mounted frame of claim 4, wherein a knurled nut is rotatably mounted on the bolt above the threaded insert to secure the threaded insert in place and provide a stop for each of the respective slide assemblies.

6. The adjustable cabinet mounted frame of claim 4, wherein the bracket includes a hole and the threaded insert is of a lesser diameter than a diameter of the hole for rotation of the threaded insert in the hole.

7. The adjustable cabinet mounted frame of claim 4, wherein the threaded insert is rotatably captured in a hole of the bracket between a base of the threaded insert and a rim of the threaded insert, the rim is spaced from the base by a height greater than a thickness of the bracket.

8. The adjustable cabinet mounted frame of claim 3, wherein the bolt of each adjustment mechanism is fixed in place by a rear cross-member, the rear cross-member is secured to a floor of the cabinet.

9. The adjustable cabinet mounted frame of claim 8, wherein the rear cross member interconnects the rear end of each of the slide assemblies.

10. An adjustable cabinet mounted frame for controlling an orientation of a cabinet door of a cabinet within which the frame is mounted, said adjustable cabinet mounted frame comprising two spaced apart slide assemblies, a cross-member secured to and interconnecting the two slide assemblies, the cross-member being configured for being secured to the cabinet, and two adjustment mechanisms connected to an end respectively of each of the two slide assemblies, said two adjustment mechanisms being independently operable to raise and lower the respective end of each of the two slide assemblies, said cross member being flexible and twistable to accommodate independent operation of said two adjustment mechanisms to control an orientation of the slide assemblies and thereby the orientation of the cabinet door with respect to the cabinet dependent upon a relative amount of independent adjustment of the adjustment mechanisms, the cross member including a horizontally oriented portion connected to said two slide assemblies and a vertically rising portion elevating the horizontally oriented portion above a floor of the cabinet.

11. An adjustable cabinet mounted frame for controlling an orientation of a cabinet door of a cabinet within which the frame is mounted, said adjustable cabinet mounted frame comprising two spaced apart slide assemblies, a front cross-member secured to and interconnecting a front end of each of the two slide assemblies, and two adjustment mechanisms connected to a rear end respectively of each of the two slide assemblies, said two adjustment mechanisms being independently operable to raise and lower the respective rear end of each of the two slide assemblies, said front cross member being flexible to accommodate independent operation of said adjustment mechanisms to control an orientation of the slide assemblies and thereby the orientation of the cabinet door dependent upon an amount of independent adjustment of the adjustment mechanisms, each of the adjustment mechanisms including a bolt fixed with respect to a floor of the cabinet and a threaded insert rotatably mounted on the bolt to independently raise or lower the rear end of the respective slide assemblies upon rotation of the threaded insert.

12. The adjustable cabinet mounted frame of claim 11, wherein the front cross member includes a horizontally oriented portion connected to said two slide assemblies and a vertically rising portion elevating the horizontally oriented portion above a floor of the cabinet.

13. The adjustable cabinet mounted frame of claim 12, wherein the front cross-member includes another horizontally oriented portion for securing the front cross-member to the floor of the cabinet.

14. The adjustable cabinet mounted frame of claim 11, wherein the threaded insert of each adjustment mechanism is rotatably mounted in a bracket, the bracket is secured to the rear end of each of the respective slide assemblies to raise or lower the rear end of the slide assemblies upon rotation of the threaded insert for pivoting of the slide assemblies about the front cross-member and thereby adjusting the orientation of the cabinet door dependent upon the independent adjustment of the adjustment mechanisms.

15. The adjustable cabinet mounted frame of claim 14, wherein a knurled nut is rotatably mounted on the bolt above the threaded insert to secure the threaded insert in place and provide a stop for each of the respective slide assemblies.

16. The adjustable cabinet mounted frame of claim 14, wherein the bracket includes a hole and the threaded insert is of a lesser diameter than a diameter of the hole for rotation of the threaded insert in the hole.

17. The adjustable cabinet mounted frame of claim 14, wherein the threaded insert is rotatably captured in a hole of the bracket between a base of the threaded insert and a rim of the threaded insert, the rim is spaced from the base by a height greater than a thickness of the bracket.

18. The adjustable cabinet mounted frame of claim 11, wherein the bolt of each adjustment mechanism is fixed in place by a rear cross-member, the rear cross-member is secured to a floor of the cabinet.

19. The adjustable cabinet mounted frame of claim 18, wherein the rear cross member interconnects the rear end of each of the slide assemblies.

* * * * *